US010563941B2

(12) United States Patent
Chen et al.

(10) Patent No.: US 10,563,941 B2
(45) Date of Patent: Feb. 18, 2020

(54) AUTO-RELEASING METHOD AND ARRANGEMENT OF DETACHABLE MAGAZINE FOR FIREARM

(71) Applicants: Fei Chen, Arcadia, CA (US); Rui Guo, Temple City, CA (US)

(72) Inventors: Fei Chen, Arcadia, CA (US); Rui Guo, Temple City, CA (US)

( * ) Notice: Subject to any disclaimer, the term of this patent is extended or adjusted under 35 U.S.C. 154(b) by 66 days.

(21) Appl. No.: 15/900,744

(22) Filed: Feb. 20, 2018

(65) Prior Publication Data

US 2019/0257605 A1 Aug. 22, 2019

(51) Int. Cl.
*F41A 17/38* (2006.01)
*F41A 9/59* (2006.01)

(52) U.S. Cl.
CPC ..... *F41A 9/59* (2013.01); *F41A 17/38* (2013.01)

(58) Field of Classification Search
CPC ..... F41A 9/59
See application file for complete search history.

(56) References Cited

U.S. PATENT DOCUMENTS

| | | | | | |
|---|---|---|---|---|---|
| 1,400,252 | A * | 12/1921 | Weed | F41A 9/59 | 42/18 |
| 4,664,015 | A * | 5/1987 | Kennedy | F41A 9/59 | 89/138 |
| 5,435,088 | A * | 7/1995 | Bammate | F41A 9/59 | 42/18 |
| 9,097,474 | B1 * | 8/2015 | Zins | F41A 5/04 | |
| 10,168,116 | B1 * | 1/2019 | Jen | F41A 9/67 | |
| 10,386,141 | B2 * | 8/2019 | Harris | F41A 3/66 | |
| 2015/0033608 | A1 * | 2/2015 | Power | F41A 9/59 | 42/6 |
| 2016/0348992 | A1 * | 12/2016 | Tisone | F41A 9/59 | |
| 2019/0049205 | A1 * | 2/2019 | Harris | F41A 9/66 | |

* cited by examiner

*Primary Examiner* — Gabriel J. Klein
(74) *Attorney, Agent, or Firm* — Raymond Y. Chan; David and Raymond Patent Firm

(57) ABSTRACT

An auto-releasing method and arrangement of a detachable magazine for a firearm is provided. The auto-releasing arrangement is able to physically remind the operator that it is the right time to replace the magazine and to continue fire without having to performing a series of magazine reloading operations to reset the firearm into the fire mode, wherein the magazine will automatically be released and removed from the magazine receiving cavity of the firearm. In other words, the operator can simply insert another loaded magazine into the magazine receiving cavity while the firearm still has at least one cartridge chambered for firing, so that the time cost on performing such operations can substantially be saved to increase the survival probability during a gunfight or the like.

10 Claims, 17 Drawing Sheets

AUTO-RELEASING METHOD AND ARRANGEMENT OF DETACHABLE MAGAZINE FOR FIREARM

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates a firearm, and more particularly, to a firearm magazine comprising an auto-releasing method and arrangement of firearm magazine that enables the magazine of a firearm automatically detaching and removing from the magazine receiving cavity of the firearm when the last cartridge in the magazine is chambered (has been fed to be loaded in the barrel of the firearm), it allows the operator to immediately insert a loaded magazine into the magazine receiving cavity of the firearm while there is still a last round of cartridge reminded loaded in the firearm barrel.

Description of Related Arts

A firearm, such as a rifle or pistol, inflicts damage on target by launching one or more cartridges or bullets driven by rapidly expanding high-pressure gas produced by exothermic combustion within an ammunition cartridge. Equipped with powerful firearm, anti-terrorism force, police force or military force, for example, can effectively eliminate terrorists, armed criminals or enemies to prevent any potential risks or damages. A gun-battle may occur in an anti-terrorism event or battle, during which the shooting performance of the firearm substantially determines the survival probability for the anti-terrorism force.

Most handgun or rifle, the magazine follower engages a slide-stop to hold the slide back and keep the firearm out of battery when the magazine is empty and all rounds fired. Upon inserting a loaded magazine, the operator depresses the slide stop, throwing the slide forward, stripping a round of cartridge from the top of the magazine stack and chambering it. In single-action pistols this action keeps the hammer cocked back as the new round of cartridge is chambered, keeping the handgun ready to begin firing again.

In particular, during the gunfight, gun shooters must be highly focused on on-site observation and shooting, such that they generally may not realize a magazine is empty until the last cartridge in the magazine is fired out and the slide-stop held the slide back and kept the firearm out of battery. In order to continue firing, the operator has to manually actuate a magazine release button on a side of the firearm, which is fixed in place in the magazine receiving cavity by a magazine catch body, to release and remove the empty magazine, and then insert a loaded magazine in the magazine receiving cavity. Finally, the operator has to depress the slide stop, throwing the slide forward, stripping a round of cartridge from the top of the magazine stack and chambering it in order to set the firearm in a firing mode.

Accordingly, the firearm is empty with cartridge while the procedures of reloading magazine as mentioned above for a certain period of time. It is well known that time is the lifeline for the parts engaging in a gunfight, where the one, who has stronger and continuing firing, has greater chance to survive. In practice, the operator of the firearm is virtually in a weapon-less manner, when the magazine of the firearm is empty with all rounds fired and the reloading operation is not finished yet, that he is vulnerable to being shot. In contrast, the other party in a gunfight can easily suspect and speculate a firing blank and catch this golden opportunity to attach or shot the one who is operating the reloading of the firearm. It is inevitably since such opportunity is given by the natural firing limits of the conventional firearms.

Similarly, a conventional firearm, such as CQ-A 5.56 automatic rifle, includes an upper receiver, a barrel mounted on the upper receiver, a firing mechanism removably coupled with the upper receiver, a bolt assembly received within the upper receiver, and a gas piston system, wherein the gas piston system incorporates with the bolt assembly to cycling the firing mechanism of the firearm in an automatic or semi-automatic manner.

In particular, during the firing operation, a bolt of the bolt assembly is arranged to be blocked by a bolt catch and a hammer of the firing mechanism is automatically shifted at a stand-by state to physically inform the operator that the last cartridge of the magazine is fired out. In order to continue to fire, the operator must depress a magazine catch to release the magazine and after changing another loaded magazine, the operator has to depress the bolt catch to release the bolt so as to load a new cartridge into the firing chamber to shoot. Accordingly, such firing mechanism causes great troubles in case that the time spent on changing the magazine and operating the bolt assembly could result in death during a gunfight as described above.

Consequently, in order to eliminate the firing blank period, some operators choose to replace the magazine before it is empty and all rounds fired out intentionally, such that the operator is remained ready to fire while changing the magazine and able to continue firing at once after the new magazine is loaded. However, as mentioned above, the man, at an exclusively intensive occasion, is unable to pay attention to the state of the magazine consciously. It is absolutely a waste of ammunition when all rounds of the magazine are not completely fired while, generally, there are limited loaded magazines carried by the operator to be reloaded for the firearm during a gunfight.

Therefore, it will be greatly appreciated if there is a way to economically and conveniently inform the operator the state of the magazine, especially when there is only one cartridge left in the firing chamber of the firearm, and to allow the operator to change a loaded magazine while the last cartridge is still chambered and ready to fire.

SUMMARY OF THE PRESENT INVENTION

The invention is advantageous in that it provides a detachable magazine of a firearm with auto-releasing arrangement, wherein the magazine allows an operator at the time that the last round of cartridge in the magazine is chambered in the firearm physically, the magazine automatically releases from the firearm for removal such that the operator is able to reload another loaded magazine while the firearm is still at a firing mode.

Another advantage of the invention is to provide an auto-releasing method and arrangement of a detachable magazine for a firearm, which incorporates with a magazine catch of the firearm to produce a signal to inform the operator physically at the time when the last cartridge of the magazine is loaded in the firearm.

Another advantage of the invention is to provide an auto-releasing method and arrangement of a detachable magazine for a firearm, wherein the auto-releasing arrangement is able to physically remind the operator that it is the right time to replace the magazine and to continue fire without having to performing a series of magazine reloading operations to reset the firearm into the fire mode, wherein the magazine will automatically be released and removed from the magazine receiving cavity of the firearm. In other words, the operator can simply insert another loaded magazine into the magazine receiving cavity while the firearm still has at least one cartridge chambered for firing, so that the time cost on performing such operations can substantially be saved to increase the survival probability during a gunfight or the like.

Another advantage of the invention is to provide an auto-releasing method and arrangement of a magazine for a firearm, which is able to actuate the magazine release button to depress the magazine catch to release the locking state of the magazine in the magazine receiving cavity of the firearm at the time that the last cartridge in the magazine is chambered and loaded automatically, thereby mechanically releasing the empty magazine and inform the operator to change for another loaded magazine.

Another advantage of the invention is to provide an auto-releasing method and arrangement of magazine for firearm, wherein a snap-out sound is generated when the auto-releasing arrangement of the magazine actuate the magazine catch to release the empty magazine to inform the operator for replacing another loaded magazine acoustically.

Another advantage of the invention is to provide an auto-releasing method and arrangement of a magazine for a firearm, wherein at the time the last round of cartridge in the magazine is chambered and loaded, the magazine will be released and detached by means of the auto-releasing arrangement automatically for removal, wherein the empty magazine may drop off the magazine receiving cavity of the firearm due to gravity and the operator may immediately replace another loaded magazine into the magazine receiving cavity while there is still at least one round of cartridge chambered and ready for firing during the replacement of the magazine. In addition, after the loaded magazine is replaced, for example a ten rounds magazine, the firearm has a total of (10+1) eleven rounds of cartridge loaded for firing. In other words, when the operate fires the last round of cartridge of the last magazine remained in the firing chamber of the barrel of the firearm, the uppermost cartridge of the newly loaded magazine will be chambered automatically for firing that substantially avoids the slide-stop of the firearm holding the slide back and kept the firearm out of battery as in the conventional reloading operation that requires the operator to depress the slide stop, throwing the slide forward, stripping a round of cartridge from the top of the magazine stack and chambering it in order to set the firearm in a firing mode again.

Another advantage of the invention is to provide an auto-releasing method and arrangement of a magazine for a firearm which does not required to have any complicated and expensive components or modifications employed. In one embodiment, the firearm may simply modify the size of the magazine receiving cavity to match the size of the magazine with the auto-releasing arrangement of the present invention without the need to change its structure at all.

Another advantage of the invention is to provide an auto-releasing method and arrangement of a magazine which is adapted to be used for a conventional firearm while providing the conventional firearm with the function of auto-releasing the magazine or replacement of another loaded magazine when the last round of cartridge is chambered in the firearm. Additional advantages and features of the invention will become apparent from the description which follows, and may be realized by means of the instrumentalities and combinations particular point out in the appended claims.

According to the present invention, the foregoing and other objects and advantages are attained by a detachable magazine adapted for a firearm having a magazine receiving cavity and comprising a magazine catch mechanism for locking the magazine inserted in the magazine receiving cavity in position, wherein the magazine comprises:

a magazine casing having a cartridge chamber therein adapted for receiving one or more cartridges and a cartridge opening communicating with the cartridge chamber to allow the cartridges feeding in and out therethrough;

a cartridge follower housed in the cartridge chamber;

a resilient element housed in the cartridge chamber and extended between a base of the magazine casing and the cartridge follower for providing a resilient force against the cartridge follower towards the cartridge opening, thereby the cartridges fed in the cartridge chamber are guided one after one between the cartridge follower and the cartridge opening that maintains an uppermost cartridge of the cartridges housed in the magazine at a position of the cartridge opening; and an auto-releasing arrangement comprising an actuator mounted in the cartridge chamber of the magazine casing in such a manner that the actuator is driven to move up and down along with a movement of the cartridge follower, wherein when the cartridge follower is moved by the resilient element to an uppermost position and adjacent to the cartridge opening while the last cartridge of the cartridges housed in the cartridge chamber is chambered and loaded in the firearm and leaving the magazine having no cartridge therein, the actuator actuates the magazine catch of the firearm to unlock and release the magazine for removal from the firearm.

According to another aspect of present invention, the present invention provides an auto-releasing method of a magazine for a firearm, comprising the steps of:

(a) driving an actuator to move along with a movement of a cartridge follower mounted in a cartridge chamber of a magazine casing of the magazine and supported by a resilient element housed in the cartridge chamber and extended between a base of the magazine casing and the cartridge follower; and (b) actuating a magazine catch of the firearm which is configured to lock the magazine inserted in a magazine receiving cavity of the firearm in position to unlock and release the magazine for removal from the magazine receiving cavity while a last cartridge of one or more cartridges housed in the magazine casing is leaving the magazine and chambered and loaded in the firearm for firing, such that an operator of the firearm is able to detach the empty magazine and replace another loaded magazine in the magazine receiving cavity of the firearm while there is still one cartridge being chambered and ready for firing.

In one embodiment, after the step (b) of the auto-releasing method of the present invention, the auto-releasing method further comprises a step (c) of generating a snap sound at the time when the last cartridge in the magazine is chambered and the magazine catch is released by the actuator.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
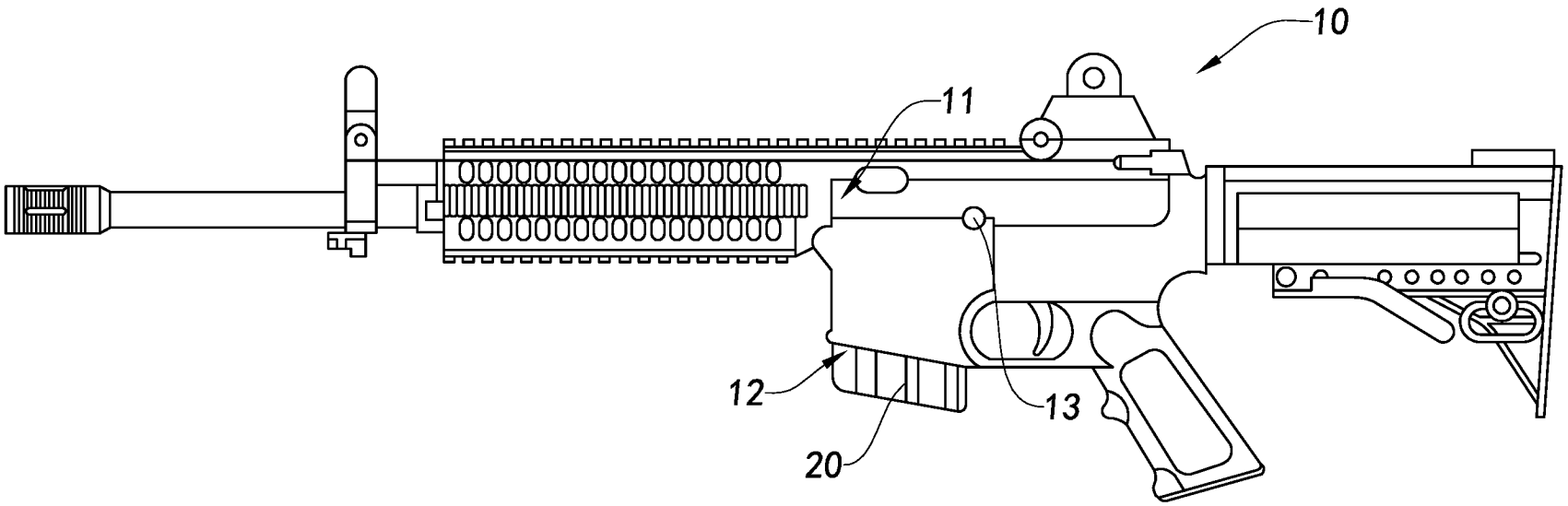
FIG. 1 is a schematic view of a firearm, which is embodied as a rifle, according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 8 of the drawings, a detachable magazine 20, 20' with auto-releasing arrangement for a firearm 10, which is embodied as a rifle according to a first preferred embodiment of the present invention is illustrated. Referring to FIGS. 8 to 14 of the drawings, the firearm 10' is embodied as a pistol according to a second preferred embodiment of the present invention. The firearm, both the rifle 10 and the pistol 10' as embodied in the first and second preferred embodiments respectively, is configured for performing firing operation has a magazine receiving cavity 12, 12' configured and arranged for receiving the magazine 20, 20' of the present invention therein for supplying ammunition cartridges 30, 30' for the firearm 10, 10' to fire.

In particular, the magazine 20, 20' in the present invention is distinguished from the conventional magazine that comprises the auto-releasing arrangement 210, 210' allows an operator at the time that the last round of cartridge 30, 30' in the magazine 20, 20' is chambered in the firearm 10, 10' physically, the magazine 20, 20' automatically releases from the firearm 10, 10' for removal such that the operator is able to reload another loaded magazine 20, 20' while the firearm 10, 10' is still at a firing mode, which is not only able to carry cartridges 30, 30' for the firearm 10, 10' but also is capable of physically informing the state of the magazine 20, 20' to the operator during shooting.

Figure 8:
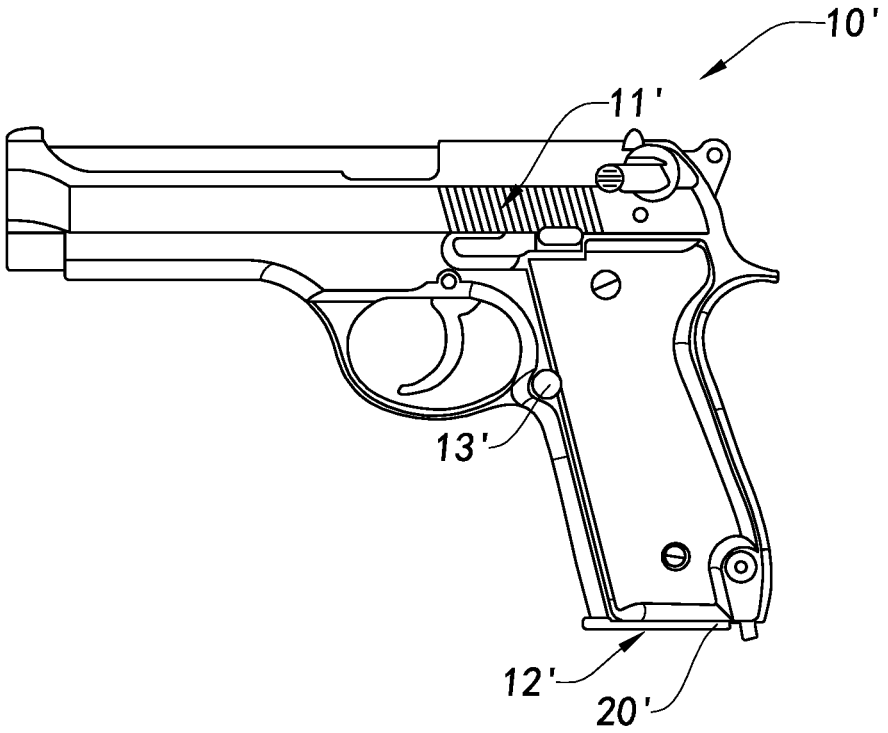
FIG. 8 is a schematic view of a firearm, which is embodied as a pistol, according to a second preferred embodiment of the present invention.

As shown in FIG. 1 and FIG. 8 of the drawings, the firearm, as a rifle 10 or a pistol 10' generally comprising an upper receiver, a barrel, a fire mechanism, an upper receiver, a bolt assembly, a bolt catch, and other necessary assemblies as those of conventional rifles and pistol, provides the magazine receiving cavity 12, 12' for receiving the magazine 20 therein and a magazine release button 13, 13' for locking the magazine 20, 20' in position in the magazine receiving cavity 12, 12'. The bolt catch is arranged to selectively control the bolt assembly to lock or unlock to a firing chamber 11, 11' which is adapted for receiving a cartridge 30, 30' in ready-to-fire position. As shown in FIG. 1, FIG. 4, FIG. 8, and FIG. 11, the magazine release button 13, 13' configured on a side of the firearm 10, 10' is linked with a magazine catch 131, 131' provided in the magazine receiving cavity 12, 12', wherein a resilient member (not shown) is provided between the magazine release button 13, 13' and the magazine catch 131, 131' such that the magazine release button 13, 13' is retained by the resilient member to protruded out of the firearm 10, 10' while the magazine catch 131, 131' is configured to removably retain the magazine 20, 20' in the magazine receiving cavity 12, 12'. When the magazine release button 13, 131' is actuated, for example being pressed down by the operator, the magazine catch 131, 131' is driven to release the retaining of the magazine 20, 20' in the magazine receiving cavity 12, 12'.

In order to fire the rifle 10 or pistol 10', the magazine 20, 20' loaded with a predetermined number of cartridges 30, 30' is inserted into the magazine receiving cavity 12, 12' of the firearm 10, 10' and a series of corresponding operations should be performed to load the uppermost cartridge 30, 30' of the cartridges 30, 30' loaded in the magazine 20, 20' into the firing chamber 11, 11' of the firearm 10, 10' properly. In particular, after the firearm 10, 20' is discharged, the bolt assembly automatically moves rearwards due to the recoil force from the firing which allows a spent cartridge casing to be ejected and another uppermost cartridge 30, 30' in the magazine 20, 20' to be uploaded from magazine 20, 20' and chambered in the firing chamber 11, 11' by means of, for example, a recoil spring which automatically returns the bolt assembly forward and pushes and loads the cartridge 30, 30' into the firing chamber 11, 11'. Then the bolt assembly is also retractable which cocks the hammer and initially readies the firearm 10, 10' for semi-automatic operation. Accordingly, no matter the rifle or the pistol a semi-automatic or an automatic firearm, the firearm 10, 10' would not generate any signals to inform the state of the magazine 20, 20', such as whether the magazine 20, 20' is empty or not, until the last cartridge 30, 30' of the magazine 20, 20 fed in the firing chamber 11, 11' is fired out. Consequently, when operating the conventional firearm 10, 10' at intensive occasions, such as a gunfight or battle, the operator may not realize the magazine 20, 20' is fully fired out and empty until the firearm 10, 10' is unable to fire mechanically.

However, as to conventional rifles and pistols, when the magazine 20, 20' is empty and the last cartridge 30, 30' in the firing chamber 11, 11' is fired out, the operator has to perform a series of reloading operations to replace another loaded magazine 20, 20' with the current empty magazine 20, 20' in the magazine receiving cavity 12, 12'. In other words, when there is no cartridge in the firearm 10, 10', the operator is required to actuate the magazine release button 13, 13' provided on a side of the firearm 10, 10' to depress the magazine catch 131, 131' to release the retaining and locking of the empty magazine 20 and to detach and remove the empty magazine 20, 20' from the magazine receiving cavity 12, 12', and then insert another loaded magazine 20, 20' into the magazine receiving cavity 12, 12'. Finally, the operator has to depress the slide stop, throwing the slide forward, stripping an uppermost cartridge 30, 30' of the cartridges 30, 30' loaded in the magazine 20, 20' and chambering it in the firing chamber 11, 11' before the operator can fire again. That causes a period of fireless interval during which the operator has no cartridge to fire and is virtually weapon-less and in great danger.

Accordingly, in order to eliminate such firing blank during replacing magazine, the magazine 20, 20' of the present invention, comprises an auto-releasing arrangement 210, 210' configuring to indicate the state of the magazine 20, 20' physically and to remind the operator to replace the empty magazine 20, 20' with another loaded magazine 20, 20' at the last timing that the last cartridge 30, 30' in the magazine 20, 20' is chambered in ready-to-fire position, so that the operator can replace another loaded magazine 20, 20' while the firearm 10, 10' is still ready for firing. After the new-loaded magazine 20, 20' is replaced and engaged in the magazine receiving cavity 12, 12' of the firearm 10, 10', it is capable of firing continuously again.

Figure 3:
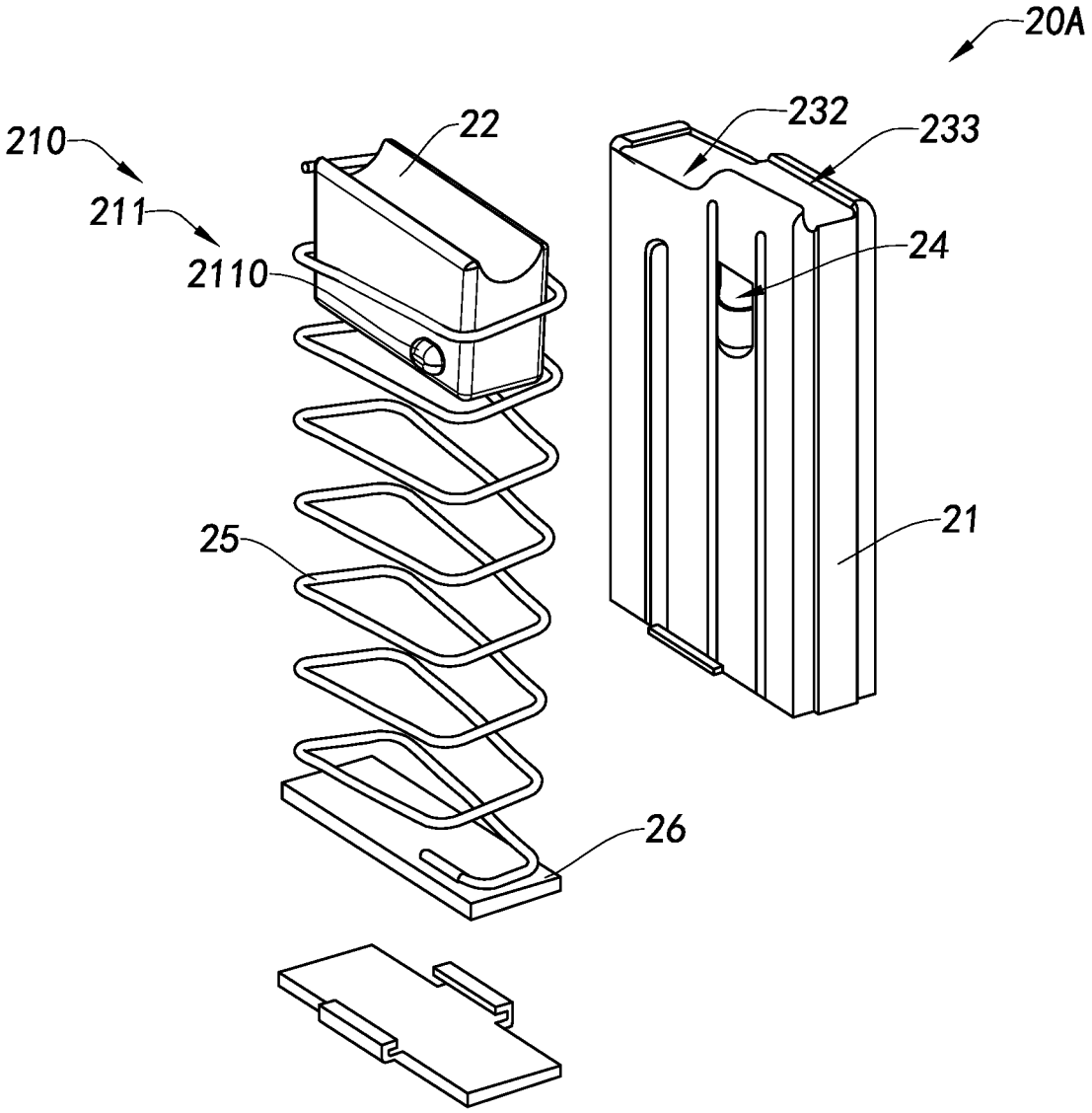
FIG. 3 is an exploded view of a magazine of the firearm according to the above first preferred embodiment of the present invention.
Figure 10:
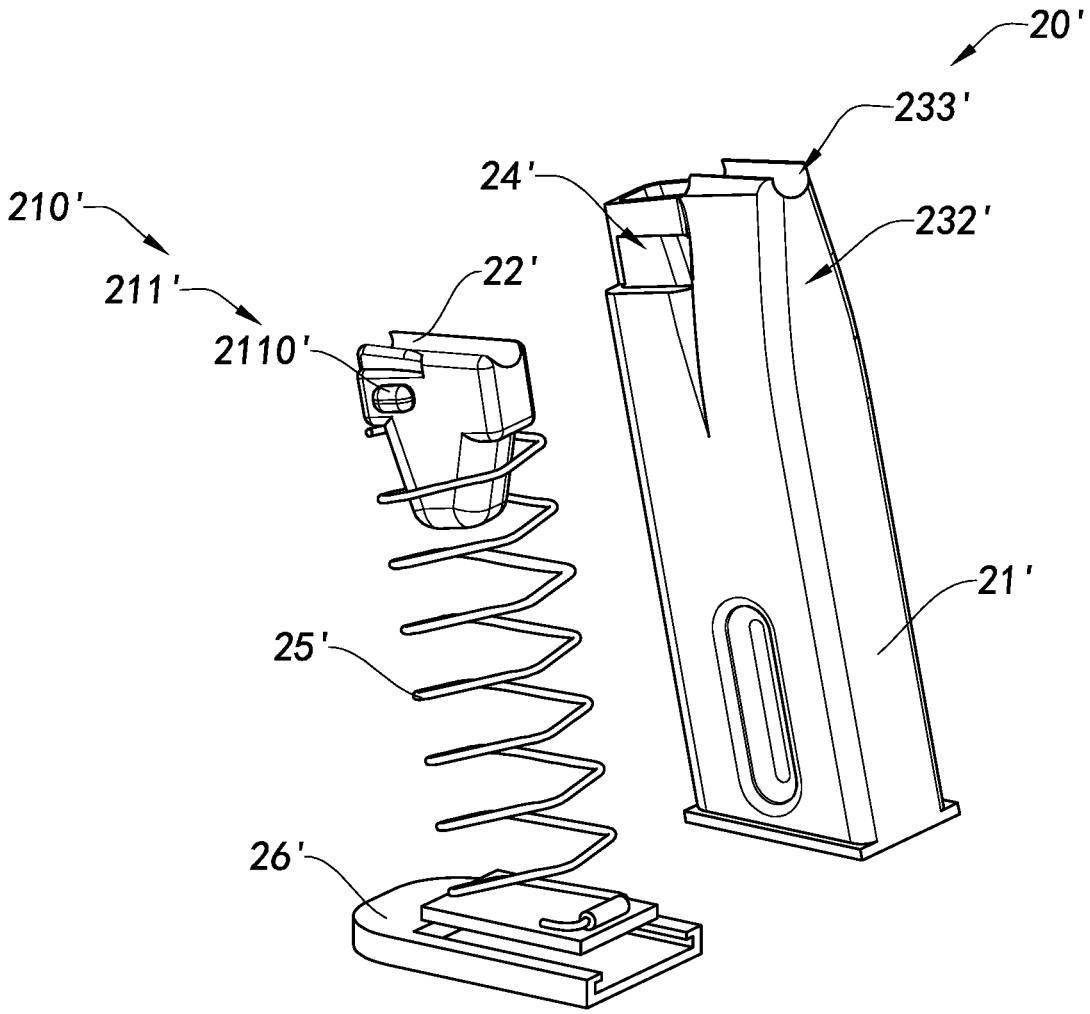
FIG. 10 is an exploded view of a magazine of the firearm according to the above preferred embodiment of the present invention.

More specifically, as shown in the FIG. 3 and FIG. 10 of the drawings, the magazine 20, 20' of the present invention comprises a magazine casing 21, 21' having a magazine catch slot 24, 24' provided in a side thereof, a cartridge follower 22, 22', a resilient element 25, 25', and the auto-releasing arrangement 210', 210'. The magazine casing 21, 21' has a cartridge chamber 232, 232' defined therein and a cartridge opening 233, 233' formed communicating with the cartridge chamber 232, 232' to allow cartridges 30, 30' receiving in and feeding out therethrough. The cartridge follower 22, 22' is mounted in the cartridge chamber 232, 232' and supported by the resilient element 25, 25' which is housed in the cartridge chamber 232, 232' and extended between a base 26, 26' of the magazine casing 21, 21' and the cartridge follower 22, 22' for providing a resilient force against the cartridge follower 22, 22' towards the cartridge opening 233, 233'. Accordingly, the cartridges 30, 30' fed in the cartridge chamber 232, 232' are guided one after one between the cartridge follower 22, 22' and the cartridge opening 233, 233' that maintains an uppermost cartridge of the cartridges 30, 30' housed in the magazine 20, 20' at a position of the cartridge opening 233, 233' for loading and chambering into the firing chamber 11, 11' by manually feeding in or by the returning of the bolt assembly forward and pushing to load the uppermost cartridge 30, 30' into the firing chamber 11, 11' during each firing. The magazine catch slot 24, 24' is formed at a side wall of the magazine casing 21, 21' and configured to releasably engage with the magazine catch 131, 131' of the firearm 10, 10' in such a manner to retain the magazine 20, 20' in the magazine receiving cavity 12, 12' in a locking state after the magazine 20, 20' is inserted into the magazine receiving cavity 12, 12' accordingly.

According to the first and second preferred embodiments of the present invention, the auto-releasing arrangement 210, 210' is provided with the cartridge follower 22, 22' and arranged in such a manner that the auto-releasing arrangement 210, 210' is moved along with the up-and-down movement of the cartridge follower 22, 22'. In particular, when the magazine 20, 20' is inserted into the magazine receiving cavity 12, 12' until the magazine catch 131, 131' of the firearm 10, 10' is inserted and retained in the magazine catch slot 24, 24' by the resilient member (not shown) so as to retain and lock the magazine 20, 20' in position, wherein the resilient member will push and retain the magazine catch 131, 131' to be engaged with the magazine catch slot 24, 24' to functionally create an interlock which prevents the magazine 20, 20' from being removed during firing. To release the magazine 20, 20', the operator may manually actuate the magazine release button 13, 13' to compress the resilient member and drive the magazine catch 131, 131' outwardly away from the magazine catch slot 24, 24', so that the magazine catch 131, 131' is disengaged with the magazine catch slot 24, 24' of the magazine 20, 20' to release the locking of the magazine 20, 20' within the magazine receiving cavity 12, 20' for removal of magazine 20, 20'.

Figure 11:
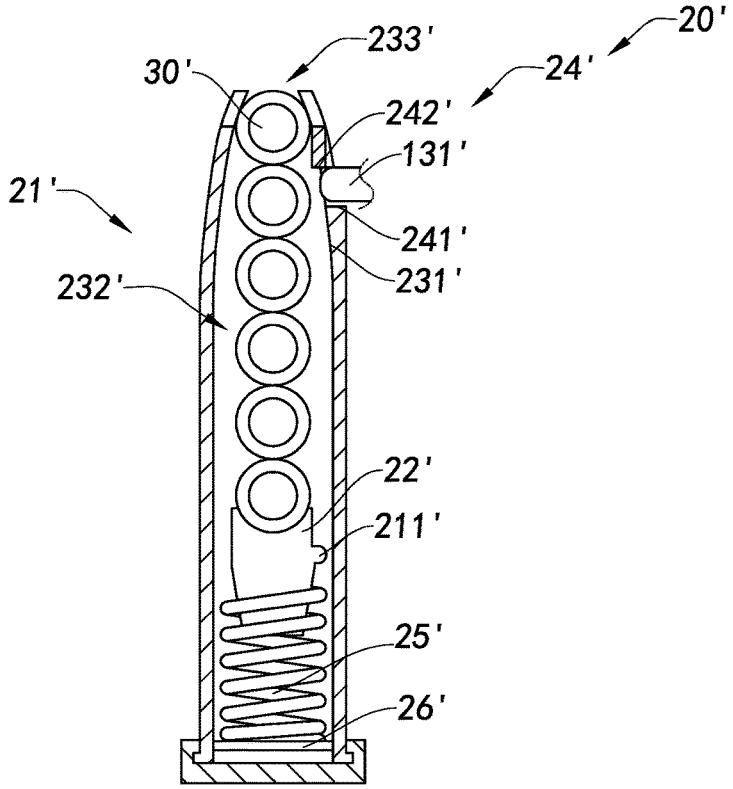
FIG. 11 is a sectional view of the magazine, illustrating the relative relationship between the magazine catch and the magazine loaded with cartridges, according to the above second preferred embodiment of the present invention.
Figure 12:
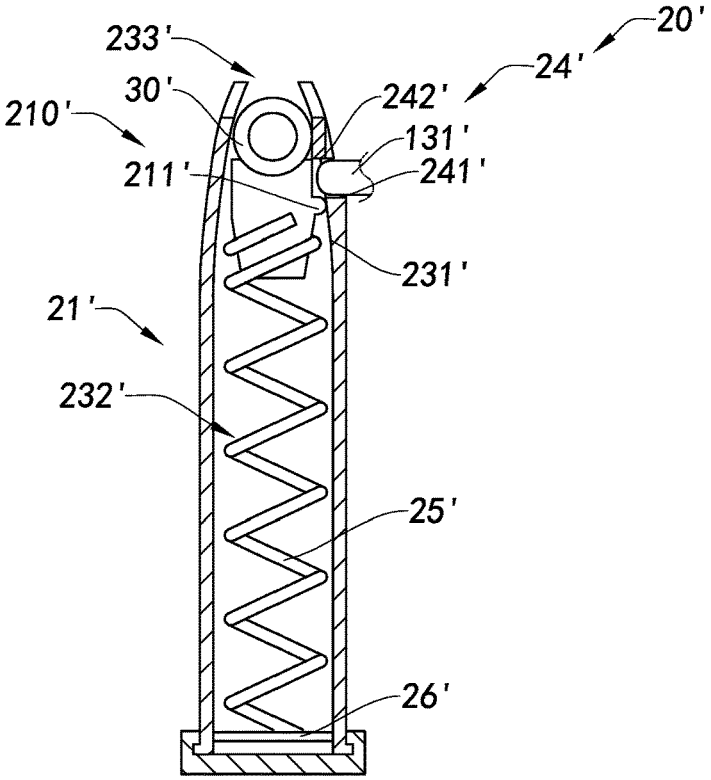
FIG. 12 is a sectional view of the magazine, illustrating the relative relationship between the magazine catch and the magazine when only one cartridge remained in the magazine, according to the above second preferred embodiment of the present invention.
Figure 13:
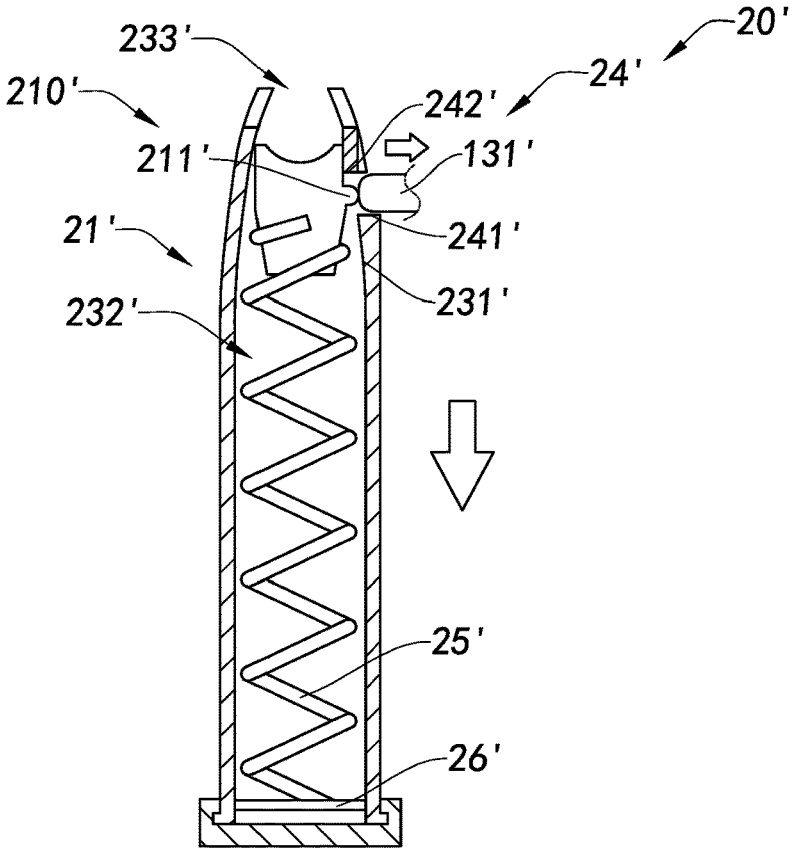
FIG. 13 is a sectional view of the magazine, illustrating the relative relationship between the magazine catch and the magazine after the last cartridge of the magazine is chambered and leaving no cartridge in the magazine, according to the above second preferred embodiment of the present invention.

According to the first and second preferred embodiments of the present invention, when one or more cartridges 30, 30' are loaded in the magazine 20, 20', as shown in FIGS. 4-5 and FIGS. 11-12, the position of the auto-releasing arrangement 210, 210' is remained lower than the magazine catch slot 24, 24' and thus the magazine 20, 20' remains being retained in the magazine receiving cavity 12, 12' due to the engagement of the magazine catch 131, 131' and the magazine catch slot 24, 24'. However, when the last cartridge 30, 30' of the magazine 20, 20' is loaded into the firing chamber 11, 11' of the firearm 10, 10', as shown in FIG. 6 and FIG. 13, the empty magazine 20, 20' is pushed upwards to its uppermost position along with the spring-loaded cartridge follower 22, 22' by the resilient element 25, 25' that the auto-releasing arrangement 210, 210' is driven by the cartridge follower 22, 22' to align with and depress the magazine catch 131, 131' towards and to disengage with the magazine catch slot 24, 24' to release the magazine 20, 20' from the magazine receiving cavity 12, 12'. The detaching of the magazine 20, 20' is also a signal informing the operator it is the time to replace another loaded magazine 20, 20'.

It worth mentioning that when the magazine 20, 20' is detached from the magazine receiving cavity 12, 12' by means of the auto-releasing arrangement 21, 21', the last cartridge 30, 30' of the previous magazine 20, 20' is just chambered into the firing chamber 11, 11' in a ready-to-fire mode. In other words, the firearm 10, 10' is still at a firing mode when the auto-releasing arrangement 21, 21' detaches the magazine 20, 20' from the magazine catch 131, 131' of the firearm 10, 10'. Therefore, the operator is able to fire while replacing the magazine 20, 20' and continue to fire at once after the empty previous magazine 20, 20' is replaced by another loaded magazine 20, 20'.

Figure 4:
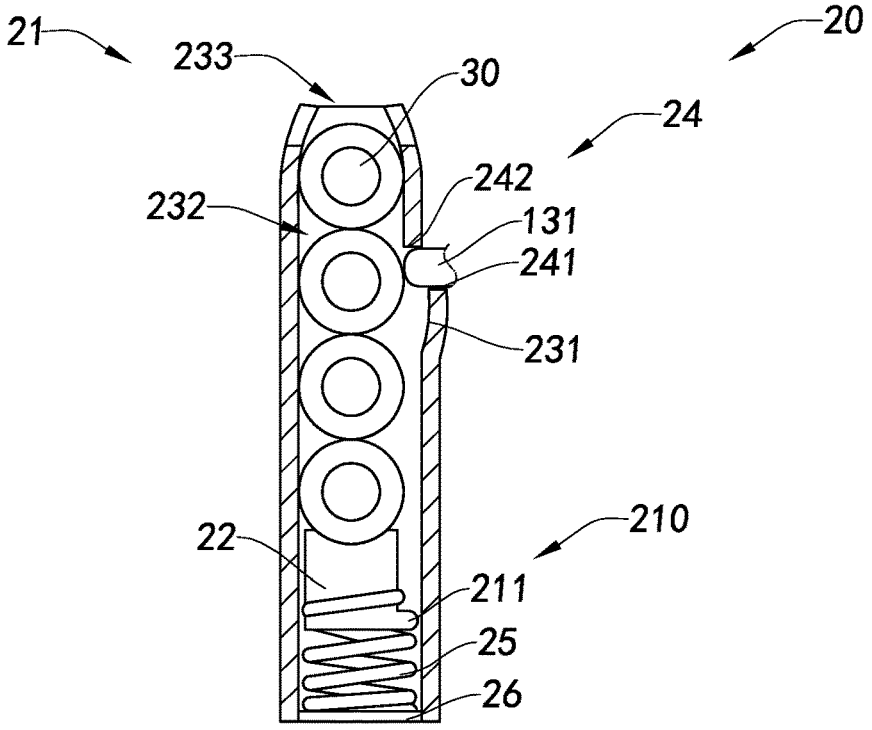
FIG. 4 is a sectional view of the magazine, illustrating the relationship between the magazine catch and the magazine loaded with cartridges, according to the above first preferred embodiment of the present invention.
Figure 5:
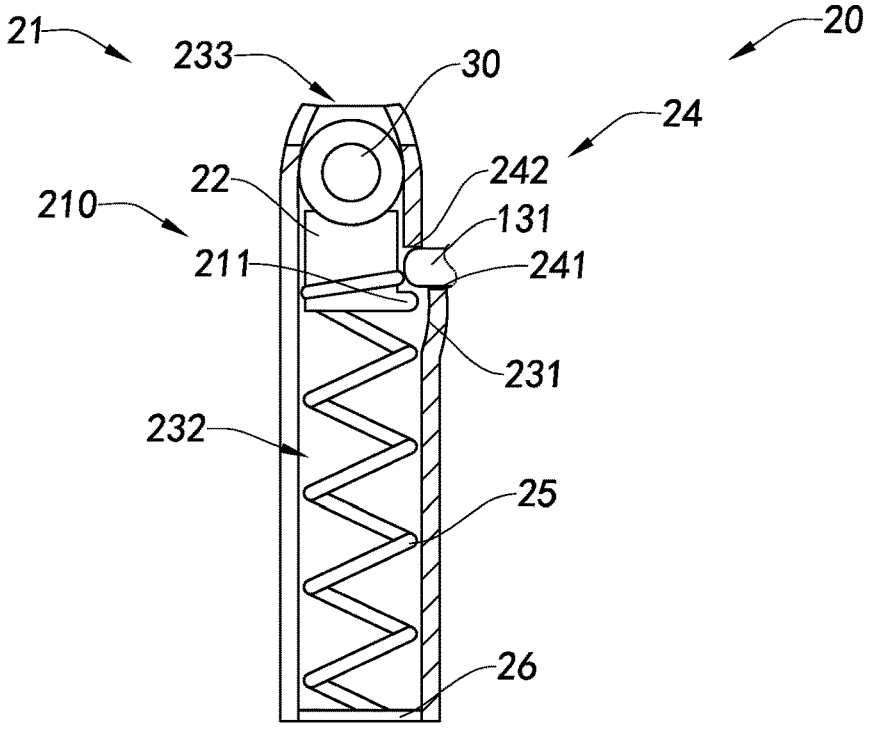
FIG. 5 is a sectional view of the magazine, illustrating the relationship between the magazine catch and the magazine when only one cartridge remained in the magazine, according to the above first preferred embodiment of the present invention.
Figure 6:
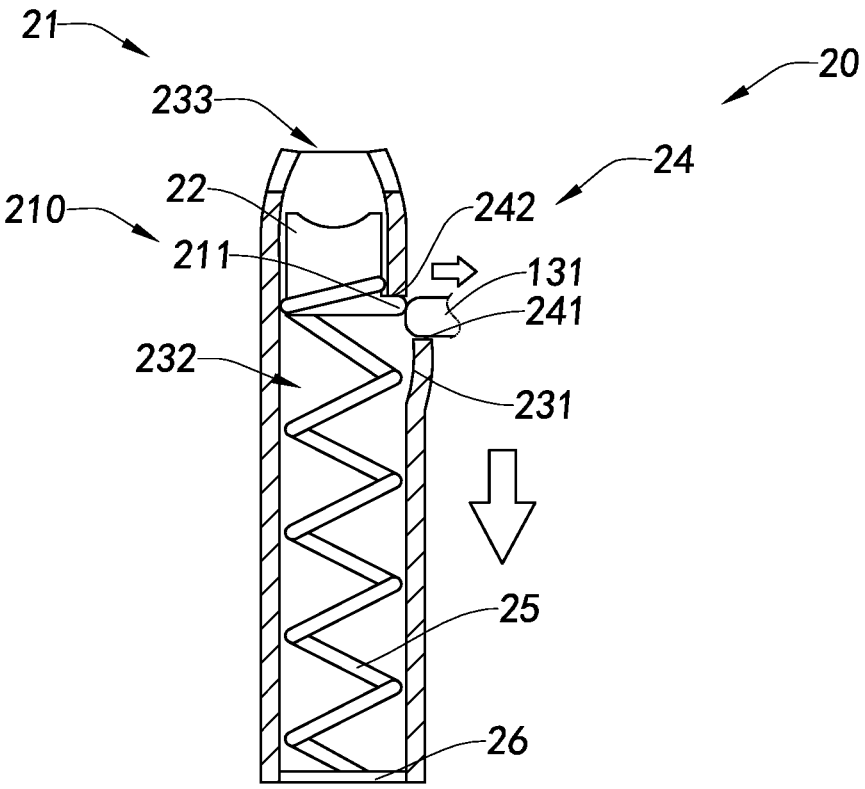
FIG. 6 is a sectional view of the magazine, illustrating the relationship between the magazine catch and the magazine after the last cartridge of the magazine is chambered and leaving no cartridge in the magazine, according to the above first preferred embodiment of the present invention.

According to the first preferred embodiment of the present invention, as shown in FIGS. 4-6 of the drawings, the auto-releasing arrangement 210 comprises an actuator 211 which is a protrusion member integrally and protrudedly formed at a side wall of a lower portion of the cartridge follower 22. According to the second preferred embodiment of the present invention, as shown in FIGS. 11-13 of the drawings, the auto-releasing arrangement 210' comprises an actuator 211' which is a protrusion member integrally and protrudedly formed at a side wall of an upper portion of the cartridge follower 22'.

Figure 7:
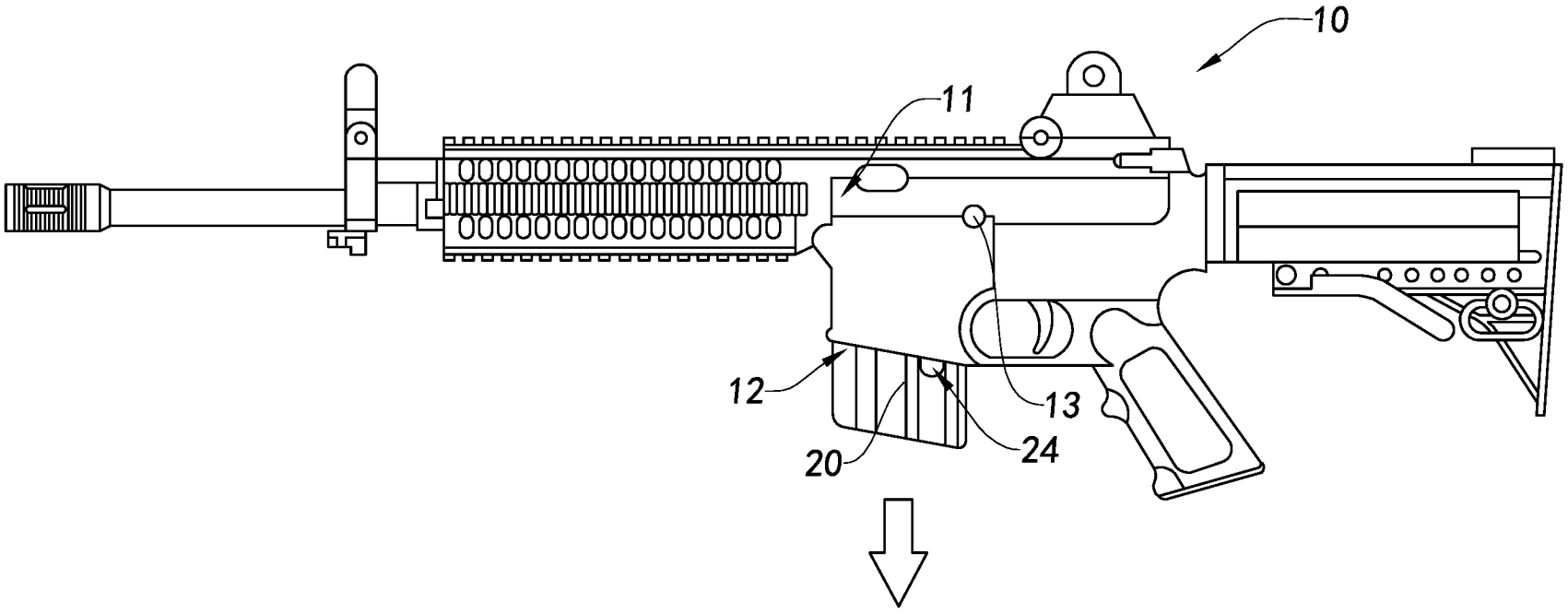
FIG. 7 is a schematic view of the firearm when the last cartridge of the magazine is chambered loaded into a firing chamber and the magazine is initially released from the magazine receiving cavity of the firearm according to the above first preferred embodiment of the present invention.
Figure 14:
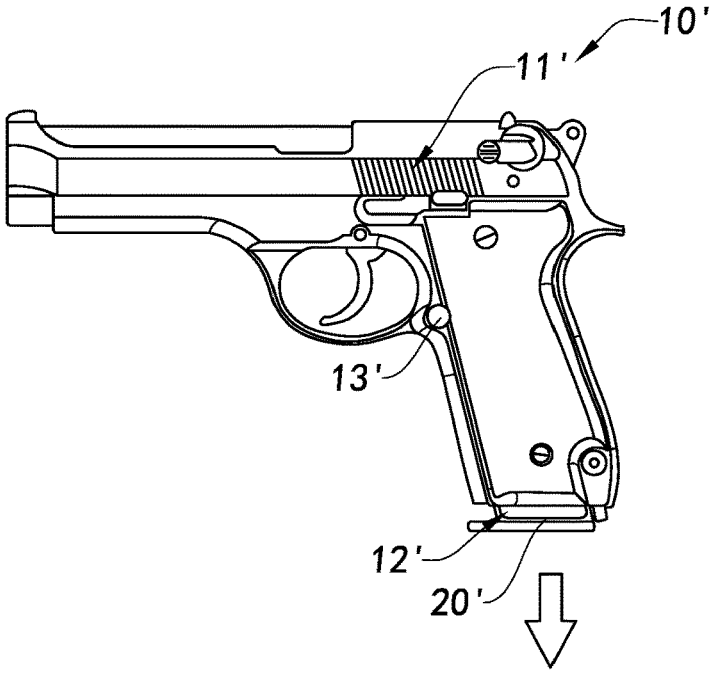
FIG. 14 is a schematic view of the firearm when the last cartridge of the magazine is loaded into a firing chamber and the magazine is initially released from the magazine receiving cavity of the firearm.
Figure 15:
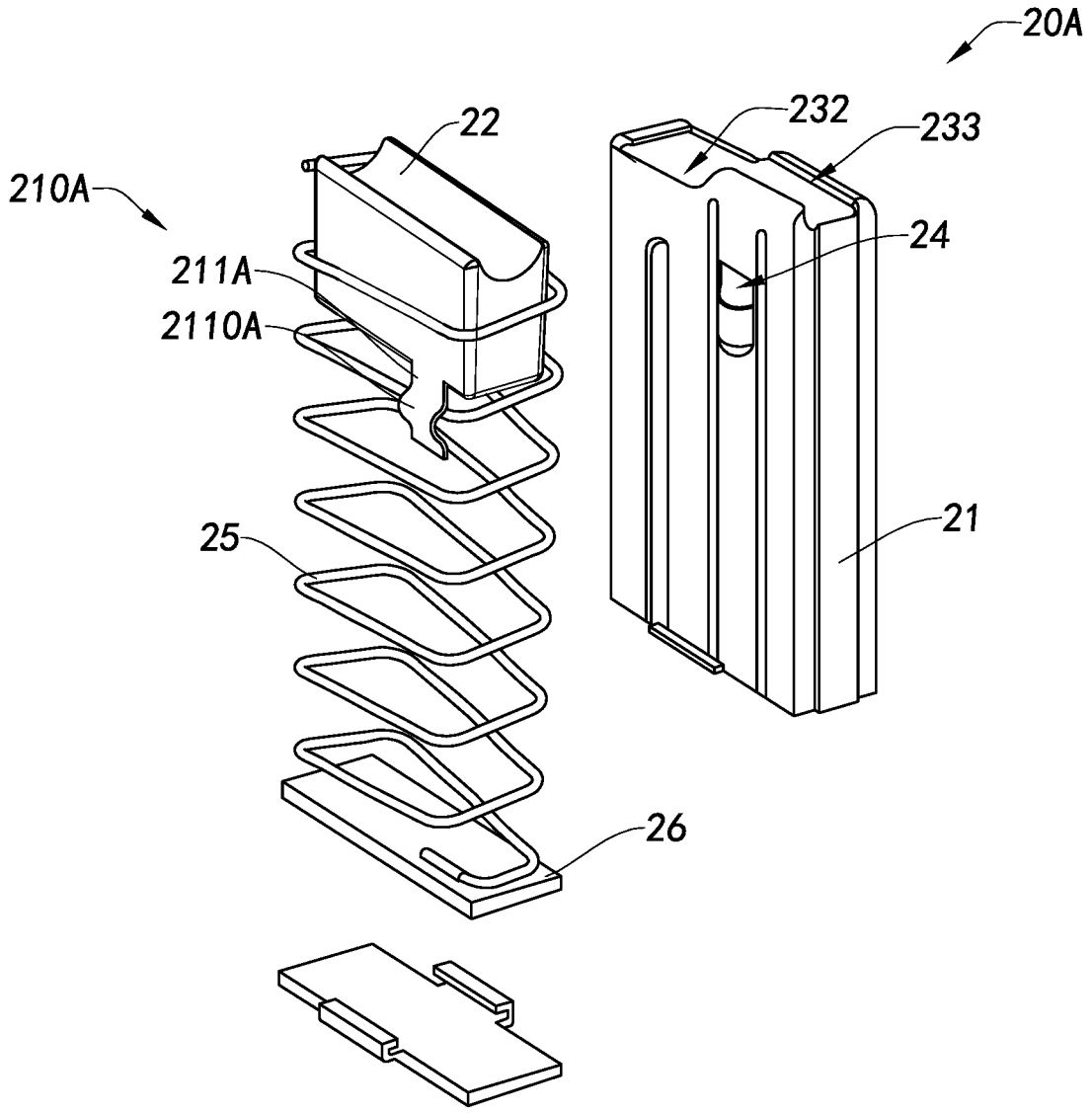
FIG. 15 is an exploded view of an alternative mode of the detachable magazine of the firearm of the above first preferred embodiment of the present invention.

According to the first and second preferred embodiments of the present invention, the actuator 211, 211' is arranged in such a manner that, when the last cartridge 30, 30' of the magazine 20, 20' is loaded into the firing chamber 11, 11' of the firearm 10, 10', the auto-releasing arrangement 210, 210' is moved to align with the magazine catch slot 24, 24' of the magazine 20, 20' and the actuator 211, 211' is just positioned at the magazine catch slot 24, 24' to bias against and depress the magazine catch 131, 131' to disengage with the magazine catch slot 24, 24' so as to release the magazine 20, 20' from the magazine receiving cavity 12, 12' mechanically, as shown in FIG. 7 and FIG. 14. At the same time, the releasing of the magazine 20, 20' from the magazine receiving cavity 12, 12' of the firearm 10, 10' sends an explicit signal to the operator, indicating that the last cartridge 30, 30' of the magazine 20, 20' has been chambered into the firing chamber 11, 11' and it is time to replace the magazine 20, 20' without uninterrupted firing.

It worth mentioning that a sound of snap is generated as the magazine 20, 20' is released and detached from the magazine catch 131, 131', such that the auto-releasing arrangement 21, 21' further provides an acoustical signal to inform the operator a timing to replace the magazine 20, 20' at the same time, as shown in FIG. 7 and FIG. 14. Therefore, even if the operator is highly focused on on-site observation and shooting, he would be aware of the empty state of the magazine 20, 20' and the right time to replace the magazine 20, 20' through this reminding signal generated by the auto-releasing arrangement 21, 21' of the magazine 20, 20'.

Moreover, according to the first and second preferred embodiments of the present invention, as shown in FIG. 3 and FIG. 10 of the drawings, the actuator 211, 211' has a cambered outer surface 2110, 2110' for ease of the movement of the auto-releasing arrangement 210, 210' relative to the magazine catch slot 24, 24'. As mentioned above, when the last cartridge 30, 30' of the magazine 20, 20' is loaded into the firing chamber 11, 11' of the firearm 10, 10', the actuator 211, 211' is aligned with and extended into the magazine catch slot 24, 24' to depress against the magazine catch 131, 131' until the magazine catch 131, 131' disengages the magazine catch slot 24, 24' to release the magazine 20, 20' for removal from the magazine receiving cavity 12, 12'. In particular, the cambered outer surface 2110, 2110' of the actuator 211, 211' substantially reduces the friction between the actuator 211, 211' and the inner walls of the magazine catch slot 24, 24', such that the actuator 211, 211' is able to move smoothly in and out of the magazine catch slot 24, 24' to disengage the magazine catch 131, 131'.

In order to further prevent any collision between the auto-releasing arrangement 210, 210' and the magazine catch slot 24, 24', the actuator 211, 211' has a thickness equal to or slight smaller than a height defined between an upper edge 241, 241' and a lower edge 242, 242' of the magazine catch slot 24, 24, such that when the actuator 211, 211' of the auto-releasing arrangement 210, 210' is moved towards the magazine catch slot 24, 24' as the cartridges 30, 30' being loaded and fired out in turns, the portion of the cartridge chamber 232, 232' below the lower edge 242, 242' of the magazine catch slot 24 provides sufficient space for the auto-releasing arrangement 210, 210' to move therebelow without any unwanted collision, and the actuator 211, 211' of the auto-releasing arrangement 210, 210' is blocked by the lower edge 242, 242' of the magazine catch slot 24, as shown in FIGS. 4-6 and FIGS. 11-13 of the drawings.

Further, as shown in FIGS. 4-6 and FIGS. 11-13 of the drawings, an inner wall of the magazine casing 21, 21' at the portion below the lower edge 242, 242' of the magazine catch slot 24, 24' may be configured as an inclined surface 231, 231' to provided an enlarged gap between the auto-releasing arrangement 210, 210' and the inner wall of the magazine casing 21, 21', for allowing the auto-releasing arrangement 210, 210' to move smoothly within the cartridge chamber 232, 232'. In other words, the auto-releasing arrangement 210, 210' and the magazine casing 21, 21' of the magazine 20, 20' are configured without affecting the normal cartridge-loading operation, while the auto-releasing arrangement 210, 210' further functions as a reminder to inform the state of the magazine 20, 20' to the operator timely.

The detachable magazine 20, 20' of the first and second preferred embodiments as described above is preferred to be configured with the firearm 10, 10' that provides the magazine receiving cavity 12, 12' configured to fittingly receive the magazine 20, 20' accordingly. In order to equip the auto-releasing arrangement of the present invention to the conventional magazine and firearm without any modification of the structure of the magazine, referring to FIGS. 15 to 22, alternative modes of the above first and second preferred embodiments of the present invention are provided.

Referring to FIGS. 15 to 18, an alternative mode of the magazine 20A of the first preferred embodiment of the present invention is illustrated, wherein the magazine 20A for the rifle 10 as shown in FIG. 1 is simply constructed as the conventional magazine that comprises the magazine casing 21, which has the cartridge chamber 232 therein, the cartridge opening 233 at one end and the magazine catch slot 24 formed at a middle portion of a side of the magazine casing 21, the cartridge follower 22, the resilient element 25, and the base 26.

Figure 2:
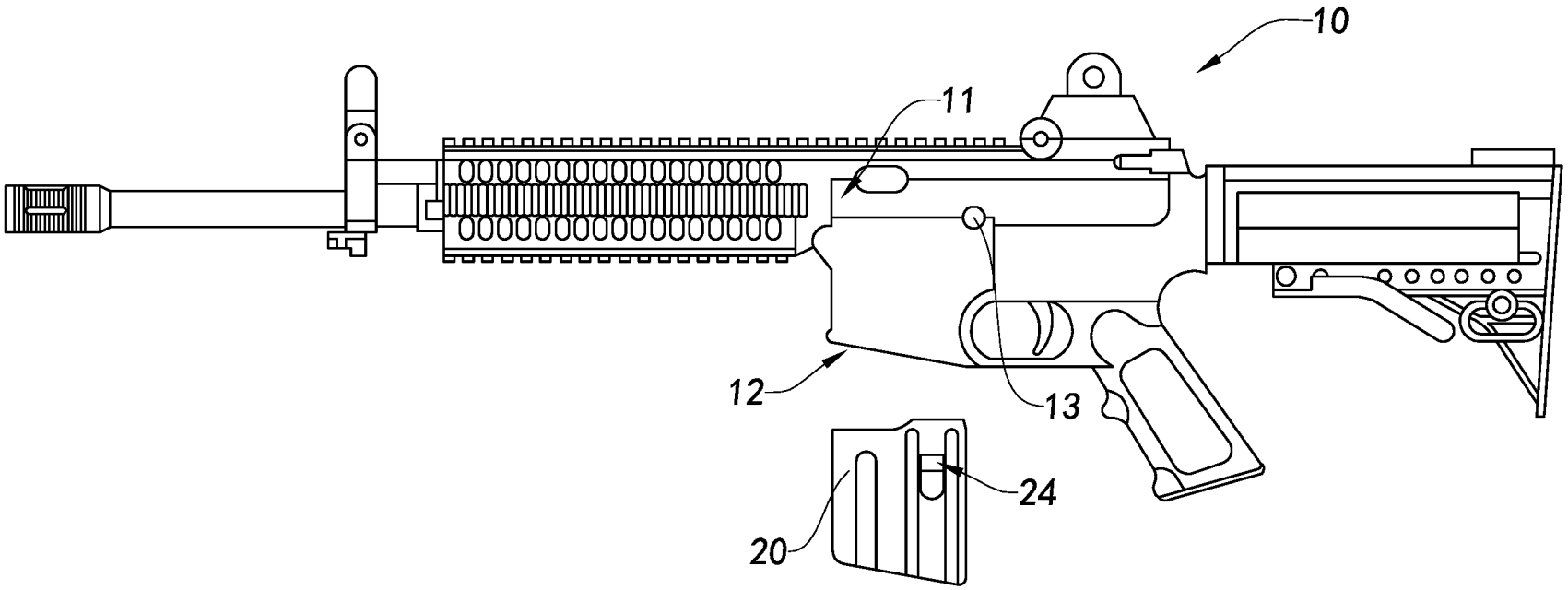
FIG. 2 is a schematic view of the firearm when the magazine is fully detached from the magazine receiving cavity of the firearm according to the above first preferred embodiment of the present invention.
Figure 18:
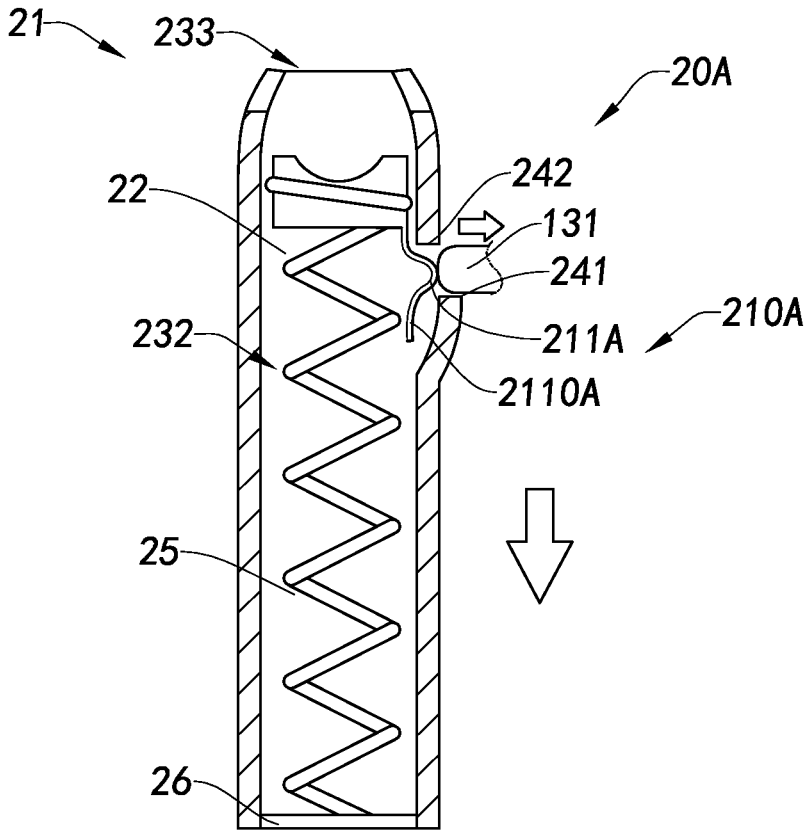
FIG. 18 is a sectional view of the alternative mode of the magazine of the above first preferred embodiment of the present invention, illustrating the relationship between the magazine catch and the magazine after the last cartridge of the magazine is chambered and leaving no cartridge in the magazine.
Figure 19:
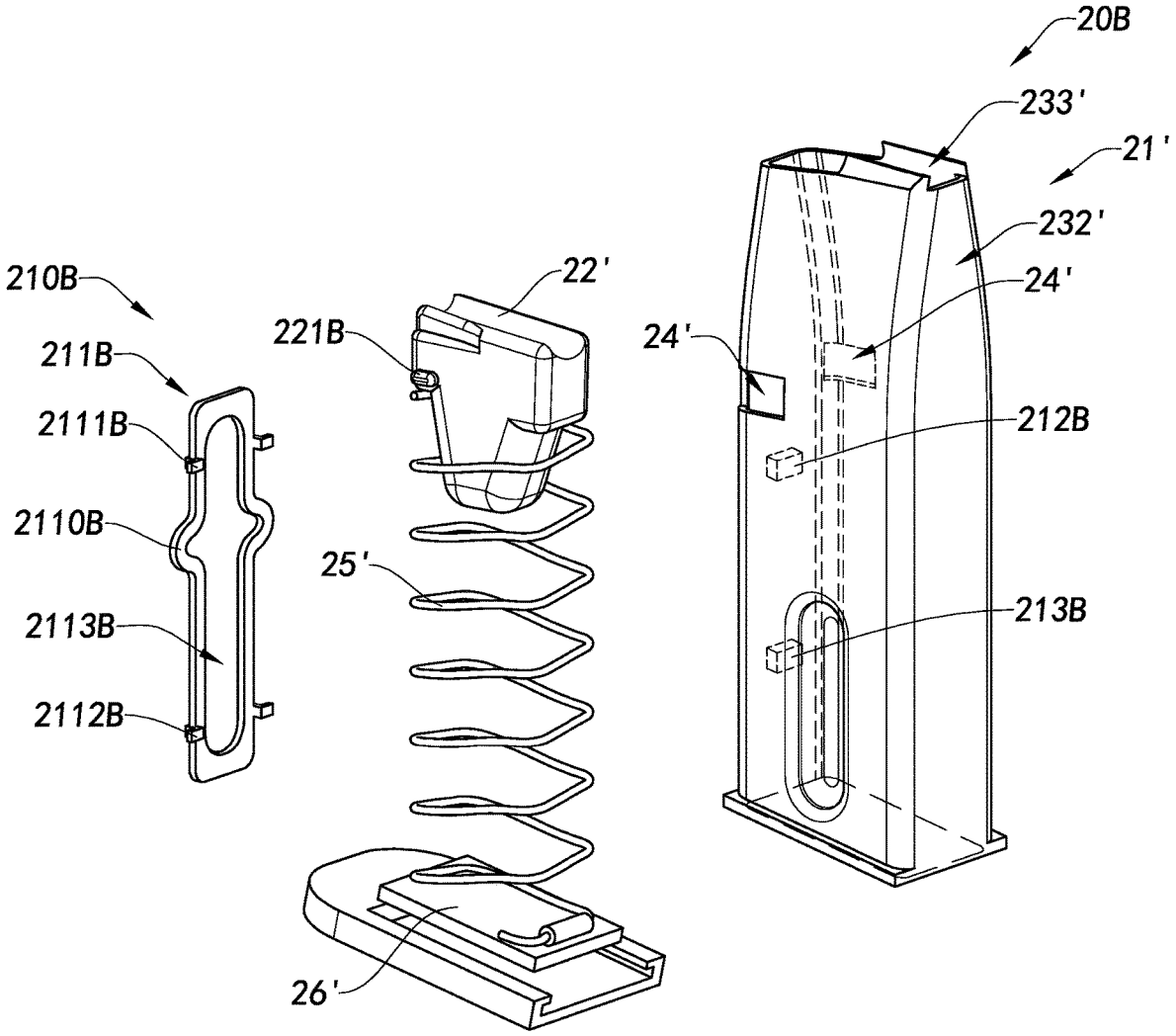
FIG. 19 is an exploded view of an alternative mode of the detachable magazine of the firearm according to the above preferred embodiment of the present invention.

In this alternative mode of the magazine 20A of the first preferred embodiment, the auto-releasing arrangement 210A is modified to comprise an actuator 211A which is an elongated resilient element (such as a metal plate) having an upper end affixed to a lower portion of the cartridge follower 22 and a lower end extended downwardly. The actuator 211A, which is extended in a gap formed between the inner wall of the magazine casing 21 and the resilient element 25. The actuator 211A further comprises a protrusion member 2110A integrally and outwardly protruded at the lower end thereof. The positions of the actuator 211A and its protrusion member 2110A are configured to enable the protrusion member 2110A extending in the magazine catch slot 24 and depressing the magazine catch 131 away from the magazine catch slot 24 to release the magazine 20A from the magazine receiving cavity 12 when the last round of cartridge 30 in the magazine 20A is chambered in the firing chamber 11, as shown in FIGS. 1, 2 and 18.

Figure 16:
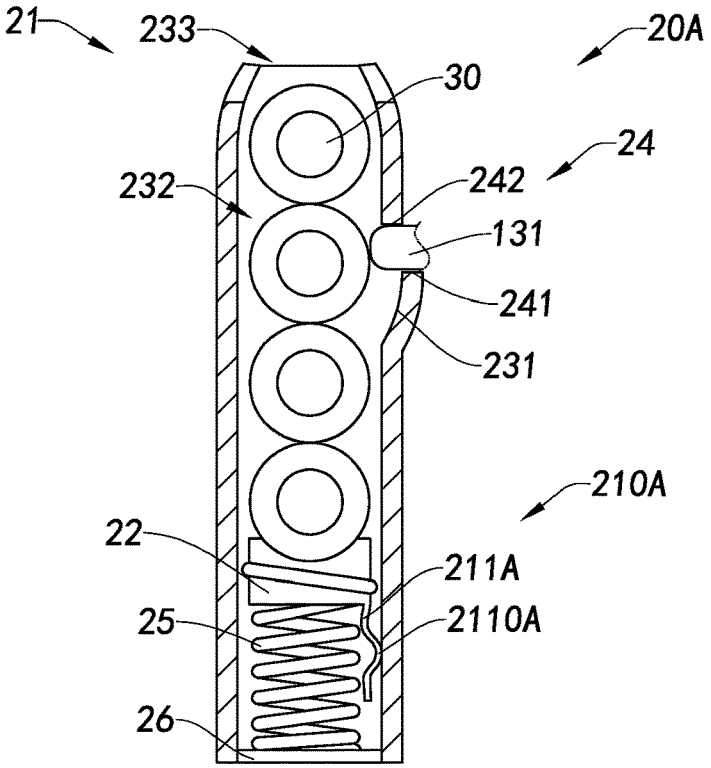
FIG. 16 is a sectional view of the alternative mode of the magazine of the above first preferred embodiment of the present invention, illustrating the relationship between the magazine catch and the magazine loaded with cartridges.

Accordingly, as shown in FIG. 16, when the magazine 20A is loaded with cartridges 30, the cartridge follower 22 is pressed down by the cartridges 30 to position in a lower position in the cartridge chamber 232 and carries the actuator 211A to a lower position in the cartridge chamber 232 too while the protrusion member 2110A is pressed by the inner wall of the magazine casing 21 inwardly. It is appreciated that since the actuator 211A is made of a thin metal plate, a resilient ability is provided enabling the actuator 211A to be slightly bent inwardly.

Figure 17:
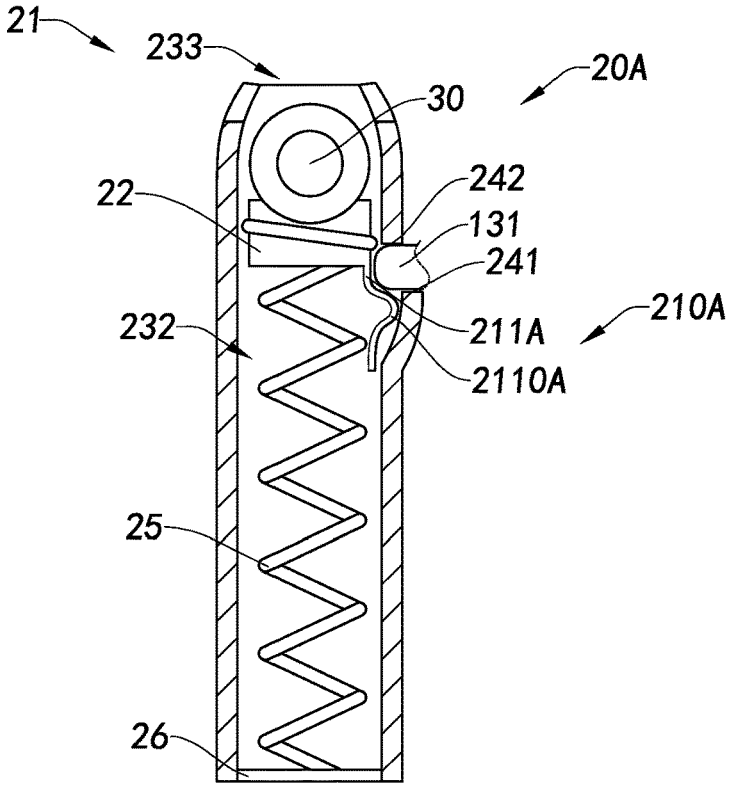
FIG. 17 is a sectional view of the alternative mode of the magazine of the above first preferred embodiment of the present invention, illustrating the relationship between the magazine catch and the magazine when only one cartridge remained in the magazine.

When one or more cartridges 30 in the magazine 20A is discharged, the resilient element 25 drives the cartridge follower 22 to move upwards which carries the actuator 211A to move together. As shown in FIG. 17, when there is a last round of cartridge 30 positioned at the uppermost position of the cartridge chamber 232 of the magazine 20A, i.e. positioned at the cartridge opening 233, the actuator 211A is driven by the cartridge follower 22 to a position right below the magazine catch slot 24 while the magazine catch 131 of the firearm 10 is remained being engaged with the magazine catch slot 24. As shown in FIG. 18, when the last round of cartridge 30 is chambered in the firing chamber 11 of the firearm 10, there is no cartridge 30 left in the magazine 20A and the cartridge follower 22 is further upwardly pushed by the resilient element 25 to the uppermost position, i.e. right at the cartridge opening 233 of the magazine 20A, wherein the actuator 211A is driven by the cartridge follower 22 to actuate to release the magazine 20A from the magazine receiving cavity 12 of the firearm 10. In particular, the protrusion member 2110A of the actuator 211A is driven by the cartridge follower 22 to a position right at the magazine catch slot 24, wherein the resilient force from the inner wall of the magazine casing 21 is released and the protrusion member 2110A pushes out to extend into the magazine catch slot 24 to depress the magazine catch 131 so as to release the engagement between the magazine catch 131 and the magazine catch slot 24, and thus the magazine 20A is released and detached for removal from the magazine receiving cavity 12 of the firearm (rifle) 10, as shown in FIGS. 7 and 18.

Referring to FIGS. 19 to 22, an alternative mode of the magazine 20B of the second preferred embodiment of the present invention is illustrated, wherein the magazine 20B for the pistol 10' as shown in FIG. 8 is simply constructed as the conventional magazine that comprises the magazine casing 21', which has the cartridge chamber 232' therein, the cartridge opening 233' at one end and the magazine catch slot 24' formed at a middle portion of a side of the magazine casing 21', the cartridge follower 22', the resilient element 25', and the base 26'.

Figure 9:
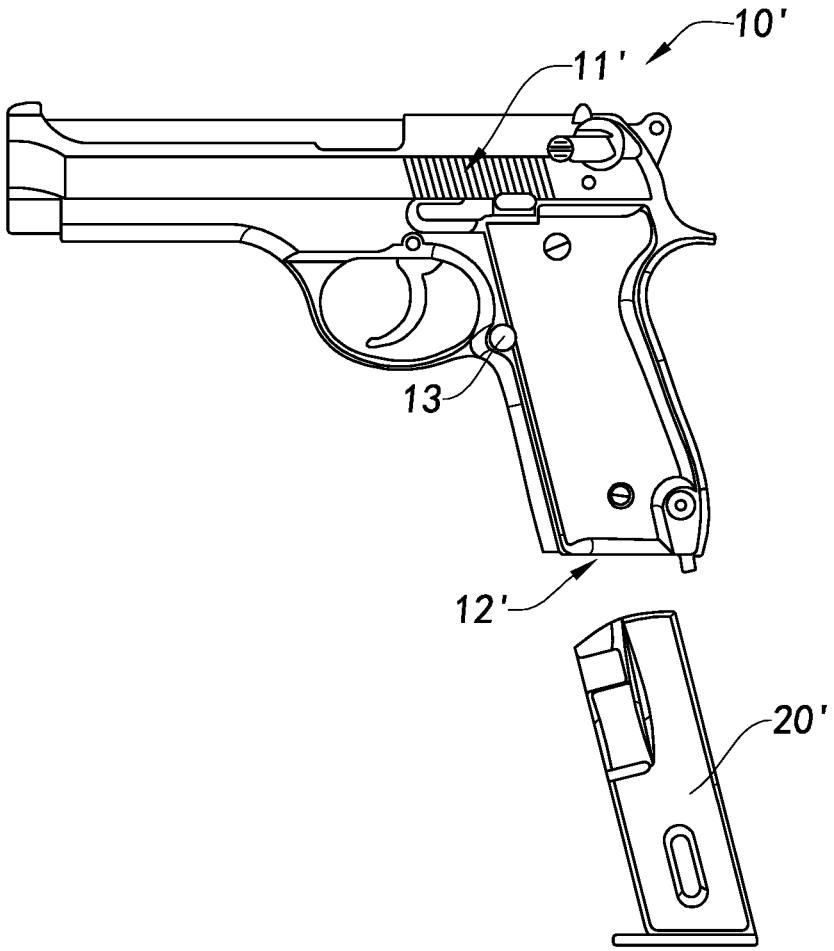
FIG. 9 is a schematic view of the firearm when the magazine is fully detached from the magazine receiving cavity of the firearm.
Figure 22:
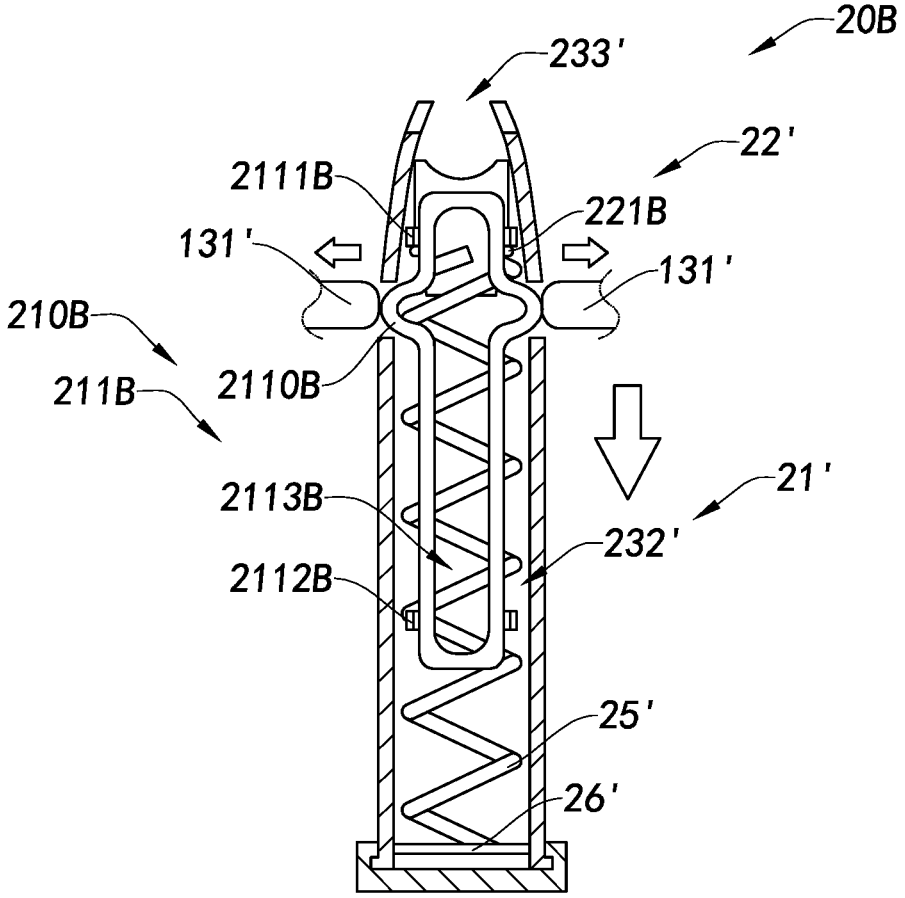
FIG. 22 is a sectional view of the alternative model of the magazine of the above second preferred embodiment of the present invention, illustrating the relative relationship between the magazine catch and the magazine after the last cartridge of the magazine is chambered and leaving no cartridge in the magazine.

In this alternative mode of the magazine 20B of the second preferred embodiment, the auto-releasing arrangement 210B is modified to comprise an actuator 211B which is an elongated element (such as a metal plate) having at least an upper guider 2111B protruded sidewardly at an upper portion of a side thereof and at least a lower guider 2112B protruded sidewardly at a lower portion of the same side having the upper guider 2111B. The actuator 211B further has an elongated longitudinal groove 2113B extended between the upper portion and the lower portion thereof. The actuator 211B, which is slidably mounted and extended in a gap formed between the inner wall of the magazine casing 21 and the resilient element 25, further comprises at least a protrusion member 2110B integrally and sidewardly protruded at the same side having the upper guider 2111B and the lower guider 2112B thereof and positioned between the upper guider 2111B and the lower guider 2112B. The positions of the actuator 211A and its protrusion member 2110A are configured to enable the protrusion member 2110A extending in the magazine catch slot 24' and depressing the magazine catch 131' away from the magazine catch slot 24' to release the magazine 20B from the magazine receiving cavity 12' when the last round of cartridge 30' in the magazine 20B is chambered in firing chamber 11', as shown in FIGS. 8, 9 and 22.

Corresponding to the upper guider 2111B and lower guider 2112B of the actuator 211B, the cartridge follower 22' also comprises at least a driver member 221B protruded therefrom and configured for moving between the upper guider 2111B and the lower guider 2112B. In addition, the magazine casing 21' further provides a pair of holders 212B, 213B spacedly protruded on an inner surface thereof, which are fittingly positioned in the longitudinal groove 2113B so as to retain and mount the actuator 211B, in an up and down slidable manner, within the gap between the resilient element 25' and the inner wall of the magazine casing 21'.

It is worth mentioning that, for magazine 20B which fit to a pistol 10' for both right-hand user and left-hand user, the magazine catch 131' may be provided at either side of the pistol 10'. Accordingly, a pair of magazine catch slots 24' is formed on both sides of the magazine 20' respectively and the actuator 211B has totally a pair of protrusion members 2110B at both sides thereof according to the alternative mode of the second embodiment as shown in FIGS. 19-22.

Figure 20:
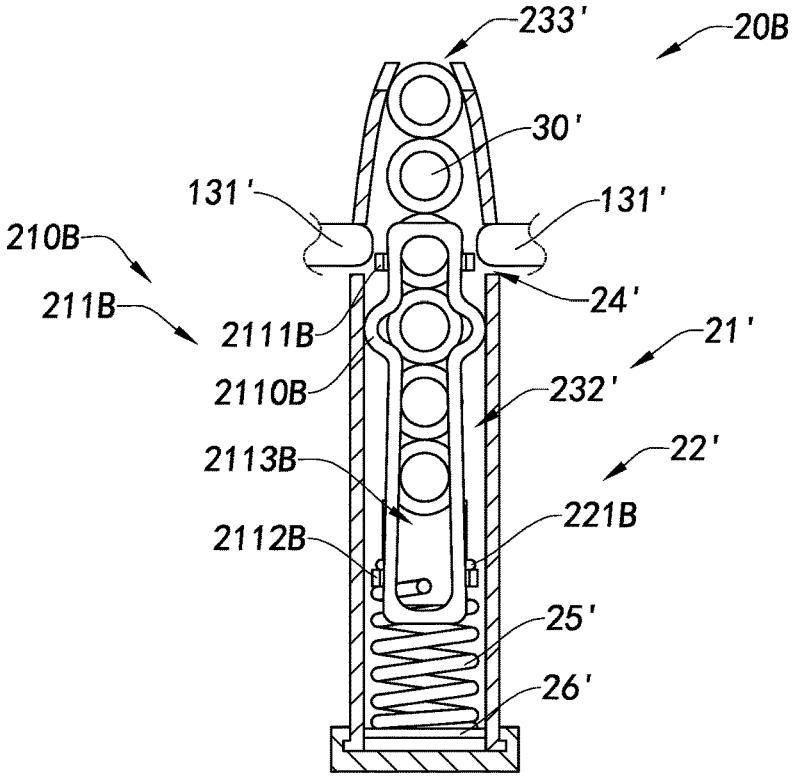
FIG. 20 is a sectional view of the alternative mode of the magazine of the above second preferred embodiment of the present invention, illustrating the relative relationship between the magazine catch and the magazine loaded with cartridges.

Accordingly, as shown in FIG. 20, when the magazine 20B is fully loaded with cartridges 30', the cartridge follower 22' is pressed down by the cartridges 30' to position in a bottom position in the cartridge chamber 232', wherein the driver member 221B of the down moving cartridge follower 22' will reach and push against the lower guider 2112B to drive the actuator 211B to move downwards together, so that the protrusion member 2110B is moved to position below the respective magazine catch slot 24' while the protrusion member 2110A is pressed by the inner wall of the magazine casing 21 inwardly. It is appreciated that since the actuator 211A has the longitudinal groove 2113B provided therein, a resilient ability is provided enabling the protrusion member 2110B to be slightly moved towards the longitudinal groove 2113B.

Figure 21:
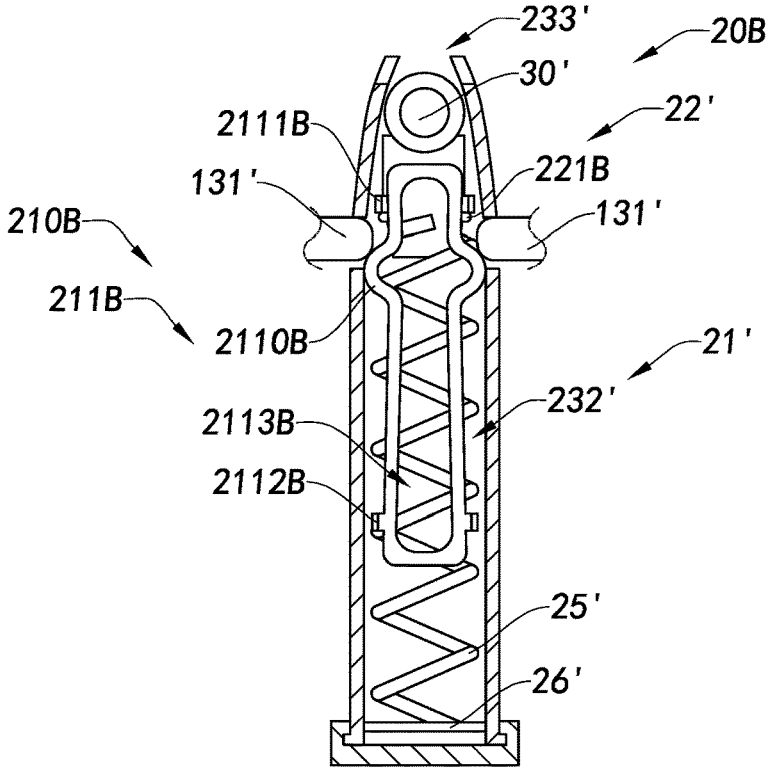
FIG. 21 is a sectional view of the alternative mode of the magazine of the above second preferred embodiment of the present invention illustrating the relative relationship between the magazine catch and the magazine when only one cartridge remained in the magazine.

When one or more cartridges 30' in the magazine 20B is discharged, the resilient element 25' drives the cartridge follower 22' to move upwards until the protrusion member 2110B of the actuator 211B reaches the upper guider 2111B, and then any further upward movement of the cartridge follower 22' will drive the actuator 211B to move upwards together while the magazine catch 131' of the firearm 10' is remained being engaged with the magazine catch slot 24'. As shown in FIG. 21, when there is only a last round of cartridge 30' positioned at the uppermost position of the cartridge chamber 232' of the magazine 20B, i.e. positioned at the cartridge opening 233', the actuator 211B is driven by the cartridge follower 22' upwards to a position that the protrusion member 2110B of the actuator 211B is positioned right below the magazine catch slot 24'. As shown in FIG. 22, when the last round of cartridge 30' is chambered in the firing chamber 11' of the firearm 10', there is no cartridge 30' left in the magazine 20B and the cartridge follower 22' is further upwardly pushed by the resilient element 25' to the uppermost position, i.e. right at the cartridge opening 233' of the magazine 20B, wherein the actuator 211B is driven by the cartridge follower 22' to actuate to release the magazine 20B from the magazine receiving cavity 12' of the firearm 10'. In particular, the protrusion member 2110B of the actuator 211B is driven by the cartridge follower 22' to a position right at the magazine catch slot 24', wherein the resilient force from the inner wall of the magazine casing 21' is released and the protrusion member 2110B pushes out to extend into the magazine catch slot 24' to depress the magazine catch 131' so as to release the engagement between the magazine catch 131' and the magazine catch slot 24', and thus the magazine 20B is released and detached for removal from the magazine receiving cavity 12' of the firearm (pistol) 10', as shown in FIGS. 8 and 22.

It is worth mentioning that the magazine 20, 20', 20A, 20B comprising the auto-releasing arrangement 210, 210', 210A, 210B of the present invention has a module configuration, such that equipped with various magazine 20, 20', 20A, 20B of the present invention, the rifle or pistol is able to fire uninterruptedly during replacing the magazines 20, 20', 20A, 20B compared with conventional magazine. Moreover, the shape, the size and predetermined loading rounds of cartridge 30' can be modified according to the structure and features of a specific firearm, so long as the magazine 20, 20', 20A, 20B is mated with the magazine receiving cavity 12, 12' of the firearm 10, 10'.

Referring to FIGS. 1 to 22 of the drawings, the present invention further discloses an auto-releasing method of the magazine 20, 20', 20A, 20B for the firearm 10, 10' for the operator, wherein the method comprises the steps of:

(a) driving the actuator 211, 211', 211A, 211B to move along with a movement of the cartridge follower 22, 22' mounted in the cartridge chamber 232, 232' of the magazine casing 21, 21' of the magazine 20, 20', 20A, 20B and supported by the resilient element 25, 25' housed in the cartridge chamber 232, 232' and extended between the base 26, 26' of the magazine casing 21, 21' and the cartridge follower 22, 22'; and (b) actuating the magazine catch 131, 131' of the firearm 10, 10' which is configured to lock the magazine 20, 20', 20A, 20B inserted in the magazine receiving cavity 12, 12' of the firearm 10, 10' in position to unlock and release the magazine 20, 20', 20A, 20B for removal from the magazine receiving cavity 12, 12' while a last cartridge of one or more cartridges 30, 30' housed in the magazine casing 21, 21' is leaving the magazine 20, 20', 20A, 20B and chambered and loaded in the firearm 10, 10' for firing, such that the operator of the firearm 10, 10' is able to detach the empty magazine 30, 30' and replace another loaded magazine 30, 30' in the magazine receiving cavity 12, 12' of the firearm 10, 10' while there is still one cartridge 30, 30' being chambered and ready for firing.

In addition, after the step (b) of the auto-releasing method of the present invention, the auto-releasing method further comprises a step (c) of generating a snap sound at the time when the last cartridge 30, 30' in the magazine 20, 20', 20A, 20B is chambered and the magazine catch 131, 131' is released by the actuator 211, 211', 211A, 211B.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A magazine for a firearm having a magazine receiving cavity and comprising a magazine catch mechanism for locking said magazine inserted in the magazine receiving cavity in position, wherein said magazine comprises:

a magazine casing having a cartridge chamber therein adapted for receiving one or more cartridges and a cartridge opening communicating with said cartridge chamber to allow feeding of cartridges in and out therethrough;

a cartridge follower housed in said cartridge chamber;

a resilient element housed in said cartridge chamber and extended between a base of said magazine casing and said cartridge follower for providing a resilient force against said cartridge follower towards said cartridge opening, thereby cartridges fed in said cartridge chamber are guided one after one between said cartridge follower and said cartridge opening; and an auto-releasing arrangement comprising an actuator mounted in said cartridge chamber of said magazine casing in such a manner that said actuator is driven to move up and down along with a movement of said cartridge follower, wherein when said cartridge follower is moved by said resilient element to an uppermost position and adjacent to said cartridge opening while a last cartridge of any cartridges housed in said cartridge chamber is chambered and loaded in the firearm and leaving said magazine having no cartridge therein, said actuator actuates the magazine catch of the firearm to unlock and release said magazine for removal from the firearm, wherein said magazine casing has at least a magazine catch slot provided at a side thereof and said auto-releasing arrangement further comprises a protrusion member protruded at a position configured to enable said protrusion member to extend into said magazine catch slot adapted for depressing a magazine catch of the firearm away from said magazine catch slot to release said magazine from the magazine receiving cavity of the firearm when a last cartridge in said cartridge chamber is chambered, wherein said actuator is an elongated element having at least an upper guider protruded sidewardly at an upper portion of a side thereof and at least a lower guider protruded sidewardly at a lower portion of the same side having said upper guider.

2. The magazine, as recited in claim 1, wherein said actuator further has an elongated longitudinal groove extended between said upper portion and said lower portion thereof.

3. The magazine, as recited in claim 2, wherein said actuator is slidably mounted and extended in a gap formed between an inner wall of said magazine casing and said resilient element.

4. The magazine, as recited in claim 3, wherein said cartridge follower further comprises at least a driver member protruded therefrom, corresponding to said upper guider and said lower guider of said actuator, and configured for moving between said upper guider and said lower guider, such that when said magazine is loaded with a cartridge, said cartridge follower is pressed down by the cartridge to position in a lower position in said cartridge chamber, wherein said driver member of said cartridge follower reaches and pushes against said lower guider to drive said actuator to move downwards together, wherein said protrusion member is moved to position below said magazine catch slot while said protrusion member is pressed by said inner wall of said magazine casing inwardly while said protrusion member is moved towards said longitudinal groove, wherein when one or more cartridges in said cartridge chamber is discharged, said resilient element drives said cartridge follower to move upwards until said driver member reaches said upper guider, and then a further upward movement of said cartridge follower drives said actuator to move upwards together while the magazine catch of the firearm remains engaged with said magazine catch slot, wherein when there is only a last cartridge positioned at an uppermost position of said cartridge chamber and adjacent to said cartridge opening, said actuator is driven by said cartridge follower upwards to a position that said protrusion member is positioned right below said magazine catch slot, wherein when the last cartridge is chambered, said cartridge follower is further upwardly pushed by said resilient element to said cartridge opening of said magazine casing, wherein said protrusion member of said actuator is driven by said cartridge follower to a position right at said magazine catch slot for depressing the magazine catch to release said magazine from the magazine receiving cavity of the firearm.

5. The magazine, as recited in claim 2, wherein said actuator comprises at least a protrusion member sidewardly protruded at the same side having said upper guider and said lower guider, wherein positions of said actuator and said protrusion member are configured to enable said protrusion member to extend into said magazine catch slot for depressing the magazine catch away from said magazine catch slot to release said magazine from the magazine receiving cavity when the last cartridge in said cartridge chamber is chambered.

6. The magazine, as recited in claim 5, wherein said cartridge follower further comprises at least a driver member protruded therefrom, corresponding to said upper guider and said lower guider of said actuator, and configured for moving between said upper guider and said lower guider, such that when said magazine is loaded with a cartridge, said cartridge follower is pressed down by the cartridge to position in a lower position in said cartridge chamber, wherein said driver member of said cartridge follower reaches and pushes against said lower guider to drive said actuator to move downwards together, wherein said protrusion member is moved to position below said magazine catch slot while said protrusion member is pressed by said inner wall of said magazine casing inwardly while said protrusion member is moved towards said longitudinal groove, wherein when one or more cartridges in said cartridge chamber is discharged, said resilient element drives said cartridge follower to move upwards until said driver member reaches said upper guider, and then a further upward movement of said cartridge follower drives said actuator to move upwards together while the magazine catch of the firearm remains engaged with said magazine catch slot, wherein when there is only a last cartridge positioned at an uppermost position of said cartridge chamber and adjacent to said cartridge opening, said actuator is driven by said cartridge follower upwards to a position that said protrusion member is positioned right below said magazine catch slot, wherein when the last cartridge is chambered, said cartridge follower is further upwardly pushed by said resilient element to said cartridge opening of said magazine casing, wherein said protrusion member of said actuator is driven by said cartridge follower to a position right at said magazine catch slot for depressing the magazine catch to release said magazine from the magazine receiving cavity of the firearm.

7. The magazine, as recited in claim 5, wherein said actuator is slidably mounted and extended in a gap formed between an inner wall of said magazine casing and said resilient element.

8. The magazine, as recited in claim 7, wherein said cartridge follower further comprises at least a driver member protruded therefrom, corresponding to said upper guider and said lower guider of said actuator, and configured for moving between said upper guider and said lower guider, such that when said magazine is loaded with a cartridge, said cartridge follower is pressed down by the cartridge to position in a lower position in said cartridge chamber, wherein said driver member of said cartridge follower reaches and pushes against said lower guider to drive said actuator to move downwards together, wherein said protrusion member is moved to position below said magazine catch slot while said protrusion member is pressed by said inner wall of said magazine casing inwardly while said protrusion member is moved towards said longitudinal groove, wherein when one or more cartridges in said cartridge chamber is discharged, said resilient element drives said cartridge follower to move upwards until said driver member reaches said upper guider, and then a further upward movement of said cartridge follower drives said actuator to move upwards together while the magazine catch of the firearm remains engaged with said magazine catch slot, wherein when there is only a last cartridge positioned at an uppermost position of said cartridge chamber and adjacent to said cartridge opening, said actuator is driven by said cartridge follower upwards to a position that said protrusion member is positioned right below said magazine catch slot, wherein when the last cartridge is chambered, said cartridge follower is further upwardly pushed by said resilient element to said cartridge opening of said magazine casing, wherein said protrusion member of said actuator is driven by said cartridge follower to a position right at said magazine catch slot for depressing the magazine catch to release said magazine from the magazine receiving cavity of the firearm.

9. The magazine, as recited in claim 1, wherein said actuator comprises at least a protrusion member sidewardly protruded at the same side having said upper guider and said lower guider, wherein positions of said actuator and said protrusion member are configured to enable said protrusion member to extend into said magazine catch slot for depressing the magazine catch away from said magazine catch slot to release said magazine from the magazine receiving cavity when the last cartridge in said cartridge chamber is chambered.

10. The magazine, as recited in claim 1, wherein said actuator is slidably mounted and extended in a gap formed between an inner wall of said magazine casing and said resilient element.

* * * * *